United States Patent [19]

Woogerd

[11] Patent Number: 4,556,434

[45] Date of Patent: Dec. 3, 1985

[54] SEWER CLEANING FOAM COMPOSITION AND METHOD

[75] Inventor: Stanley M. Woogerd, San Rafael, Calif.

[73] Assignee: Airrigation Engineering Company, Inc., Carmel Valley, Calif.

[21] Appl. No.: 679,815

[22] Filed: Dec. 10, 1984

[51] Int. Cl.[4] ..... B08B 9/02

[52] U.S. Cl. ..... 134/22.14; 134/36; 252/106; 252/153; 252/154; 252/158; 252/159; 252/307; 252/541; 252/544; 252/545; 252/546; 252/DIG. 11

[58] Field of Search ..... 134/22.14, 24, 36; 252/106, 541, 544, 545, 546, 153, 154, 155, 158, 159, 160, 307, DIG. 11

[56] References Cited

U.S. PATENT DOCUMENTS

| | | | |
|---|---|---|---|
| 3,713,404 | 1/1973 | Lavo et al. | 252/307 X |
| 3,741,807 | 6/1973 | Horne | 134/24 |
| 3,874,926 | 4/1975 | Horne et al. | 134/24 |
| 3,914,185 | 10/1975 | Inamorato | 252/307 X |
| 4,083,384 | 4/1978 | Horne et al. | 134/24 X |
| 4,325,831 | 4/1982 | Watson et al. | 252/307 X |
| 4,347,145 | 8/1982 | Gregorian et al. | 252/307 X |
| 4,365,967 | 12/1982 | Guth et al. | 252/307 X |
| 4,442,018 | 4/1984 | Rand | 252/307 |

*Primary Examiner*—Marc L. Caroff

*Attorney, Agent, or Firm*—Owen, Wickersham & Erickson

[57] ABSTRACT

An adjuvant for use with metham solution consisting essentially, by weight, of:

15% isopropanol
12.4% water
20.2% sodium dihexyl sulfosuccinate
13.3% nine mole ethylene oxide adduct of nonyl phenol
11.7% sodium 2-ethyl hexyl sulfate
9.2% triethanol amine sulfonate
7.5% tetrasodium N-(1,2 dicarboxy ethyl)-N-octadecyl sulfosuccinamate
4.7% coconut oil superamide
4.6% dimethyl or isopropyl amine sulfonate
1.4% tetrasodium ethylene diamine acetic acid.

Also, the mixture of the adjuvant with a water solution of metham, both dilute and concentrated and with or without dichlobenil.

11 Claims, No Drawings

SEWER CLEANING FOAM COMPOSITION AND METHOD

This invention relates to an improved sewer cleaning composition, both as a concentrate for dilution at time of use and also as a diluted formulation. It also relates to an adjuvant for use with active ingredients of sewer cleaning composition to improve their performance.

BACKGROUND OF THE INVENTION

At one time there was no good way of cleaning sewers chemically. When cleaned mechanically as by rotary units or by similar devices, the roots tended to regrow until once again they reduced the passage area in the sewer, either closing the sewer off entirely, or at least reducing the flow through the sewer. During that period, copper sulfate was often recommended, but the trouble was that the copper sulfate acted only on the parts of the roots that were actually in the liquid along the bottom of the sewer, and sewers are purposely left to be mainly empty, not to be filled with liquid.

Radical improvements in the cleaning of sewers began with a new composition invented and introduced by Frederick F. Horne, and described in U.S. Pat. No. 3,741,807. Since that time some improvements have been made in foam-forming adjuvant. The present invention addresses problems which were not solved by the Horne or later inventions, and either solves them or substantially ameliorates the situation.

The composition shown in U.S. Pat. No. 3,741,807 consisted principally of three ingredients with an optional fourth one. The first ingredient was simply water which carried the active ingredients. The second ingredient was an alkaline metal alkyl dithiocarbamate, typically the one often called metham, and sold by Stauffer Chemical Co. in water solution under the trademark Vapam, Vapam being essentially a solution of about 37% metham and about 63% water. The third ingredient was a surfactant used in what would usually be considered gross quantities. The surfactant and the metham had to be compatible, and very few surfactants are compatible with metham. Moreover, as noted, the surfactant had to be in much greater quantity than where the surfactant was used merely as a wetting agent. The surfactant and the metham cooperated in a synergistic manner to do several things: (1) to maintain the active metham fumigant for a while in an active foam state on the pipe and root surfaces, (2) to provide, upon spraying or upon addition of air, a metham-surfactant foam, and to make that foam adhere well to all surfaces instead ineffectually running or dripping off the roots, (3) to remove coatings of slimes, greases, soaps, and dirt that have covered and protected the roots, and (4) to hold the metham fumigant on and near the cleaned root surfaces where the fumigant could be most effective. When attempts were made to use these ingredients separately they were not as successful, and the attempt to use the metham without large quantities of surfactant resulted in failure in instances where the roots were dirty or covered with slime or greases, such use without surfactant being successful only when the roots were at least relatively clean.

An added ingredient, often but not always used, was dichlobenil, which prevented rapid regrowth of the roots.

Although this composition has been very successful, there were factors that kept it from being as effective as would be desired, and it is these which are addressed by the present invention.

For one thing, the foam generated by the prior product was not sufficiently foamy to cling as persistently as would be hoped; it tended to drain away too quickly. Also, the foam was relatively unstable and of rather low density. The product also tended to result in a composition affording too low an expansion ratio to be sufficiently economical of its expensive constituents. Moreover, the concentrate tended to be unstable on long storage.

There were still other problems. One of these was that when hard water, especially water containing iron, was used to dilute the material, there tended to be a deleterious effect on the stability of the product.

The prior invention was such a great improvement over anything which the prior art had seen, that it has obtained wide use, but the present invention is a great improvement over that, and greatly improves overall efficiency.

The prior product was applied either (1) by moving a sprayer through the sewer, the spraying acting to produce a foam, (2) by soaking techniques, which though effective, tended to be rather wasteful of the material, and (3) by a later-developed foaming technique, using a pump that introduced air and water into the concentrate, and then conducting the foam itself directly into the sewer pipe, filling a certain length of it. In many ways this third technique was the best way to use the product, so far as amount of material required, but still there were difficulties due to the relatively low expansion ratio, the somewhat rapid drainage time, and the lack of sufficient clinging action of the foam to insure complete results.

The present invention therefore solves that problem by using—instead of a simple surfactant such as Triton X100, which was used generally in the previous product—a mixture of materials which when put together in the right proportion tends to produce optimum results and to solve the problems mentioned. The concentrate is then much more stable during storage, being much less sensitive to high heat or to freezing temperatures, and has good storage stability in the range of 33° to 90° F. It also produces a greatly improved foam which is denser, has a much larger expansion ratio, that is, can include much more air, is very slow to drain away and tends to cling to the roots very well. The present invention also gives improved foam stability, due to the discovery of the effect of pH on the stability of the product and use of the proper pH. The invention also provides improved release of the methyl isothiocyanate, which is the active ingredient coming from sodium methyl dithiocarbamate, or metham.

SUMMARY OF THE INVENTION

The adjuvant composition of this invention consists essentially by weight of the following ingredients:

Solvent: about 27.4%
- 15% isopropanol
- 12.4% water

Solute: about 72.6%
- 20.2% sodium dihexyl sulfosuccinate
- 13.3% seven to ten mole ethylene oxide adduct of octyl or nonyl phenol
- 11.7% sodium 2-ethyl hexyl sulfate
- 9.2% triethanol amine sulfonate
- 7.5% tetrasodium N-(1,2 dicarboxy ethyl)-N-octadecyl sulfosuccinamate 4.7% coconut oil superamide
4.6% lower alkyl amine sulfonate
1.4% tetrasodium ethylene diamine acetic acid.

When the adjuvant is properly mixed with the other materials a concentrated formulation is obtained as follows:

A. About 74.15 parts of a solution made up essentially of
37% sodium methyldithiocarbamate
63% water
B. About 22.31 parts of the adjuvant as just described, and
C. 3.54 parts a dry material made up essentially of about
50% dichlobenil
50% wettable clay.

The dichlobenil-clay mixture is made so that all of it passes through a 100 mesh screen and at least 97% passes through a 325 mesh screen. In no more than one minute after vigorous mixture with twenty parts of water per one part of the dichlobenil mixture, it should be fully wet and should stay in suspension for an hour.

The concentrate has a pH between 9 and 10, preferably about 9.5, thereby affording improved stability, especially of the metham. The concentrate can be stored for eighteen months in a temperature range of 33° F. to 90° F. For use in the sewers, this concentrate is generally diluted at a ratio of one part concentrate to about 20 parts of water (by weight) and, the dilute solution is likewise diluted with air at a ratio of one part liquid to about twenty parts of air to make the foam.

The composition is not significantly systemic, but it does act very effectively to kill the roots and prevent or greatly restrain regrowth, without killing the trees or shrubs which have the roots. In fact, cleaning the sewers may set the trees and shrubs back very little, depending on what proportion of the roots of the plant actually have entered the sewer through cracks or other places.

DISCUSSION OF THE ADJUVANT

The adjuvant includes both isopropanol and water, which are freely miscible with each other, in order to provide for complete miscibility of the adjuvant with the metham solution without any incompatibility and without at all interfering with the dispersibility of the dichlobenil and its accompanying wettable clay. The percentages are such as give a substantial concentration of the more active ingredients of the adjuvant.

Each ingredient plays its part, and each should be used in approximately the indicated quantity for best results. Each ingredient, in the presence of the other ingredients, makes its own contribution to the whole.

The sodium dihexyl sulfosuccinate, which is present in larger amount by weight than the other ingredients, serves as a small bubble generator. This ingredient cooperates with the other ingredients including the surfactant portions to provide very small bubbles which tend to cling better to the roots and to result in a denser foam than would otherwise be possible, thereby holding the active ingredients on the roots for maximum time and providing for prolonged reaction time.

The surfactant acts to clean off the root surface and also as a plant cuticle penetrant. It is preferably a nine-mole ethylene oxide adduct of nonyl phenol, although it can be a seven-to ten mole ethylene oxide adduct of either octyl or nonyl phenol. These non-ionic surfactants give very good tissue penetration in addition to their cleaning function, enables the metham or its gaseous derivative to get through the slime and dirt and grease into the tissue and then to enter the tissues themselves to kill the roots.

Sodium 2-ethyl hexyl sulfate is a foaming agent that helps to give the product a high expension ratio. It also helps to improve the solubility of the other ingredients. The high expansion ratio is what enables the metham and dichlobenil to be used very economically.

Triethanol amine sulfonate is a known commercial foamer, which is used as what might be called a foam booster or foam enhancer, to give still more foam than would be gotten without it. It acts in conjunction with the other ingredients to increase the amount of foam produced and does not interfere with any of the other ingredients.

The tetrasodium N-(-1,2 dicarboxyethyl-)-N-octadecyl sulfosuccinamate is an important ingredient which acts as a solubilizer for the metham and the foaming ingredients, so that the concentrate does not have to contain as much water as would otherwise be necessary.

The coconut oil superamide is a foam stabilizer that acts in cooperation with the other ingredients, including the metham, and is compatible with them.

The lower alkyl amine sulfonate—preferably dimethyl or isopropyl amine sulfonate—provides the important function of inhibiting foam drainage, thereby lengthening the contact time of the foam material with the roots.

Finally, the tetrasodium ethylene diamine acetic acid is needed to balance the pH and to act as a chelating agent which enables the concentrate to be diluted with hard water, including water containing iron ions.

A great deal of experimentation lies behind the formula of this adjuvant and its combination with the other ingredients. The adjuvant as prepared is completely compatible with the metham and does not degenerate it; in fact, it improves its storage capabilities. The detergent function of penetrating and cleaning off the grease and slime is improved over what was obtained from Triton X100, and the foam itself is greatly improved, being more clinging, providing a denser smaller bubble type of foam, and greatly increased drainage time, that is, the time that it holds to the roots as distinct from draining off them is greatly lengthened.

As stated before, the adjuvant is mixed so that it is in a ratio of about 1 to 3 with respect to the Vapam solution which is itself nearly two-thirds water and somewhat more than one-third metham. The Vapam solution may contain other ingredients for stability and its own storage. The dichlobenil is used as stated before. The material may be made up in such a way that the dichlobenil is added only at the last minute before dilution by having it in a separate container, which is either packaged along with, or even inside, the container for the other mixture, or it may, with somewhat less desirable results, be introduced at the factory. If so, care should be taken that the concentrate be agitated before or during dilution.

Soon after dilution, the material is preferably introduced into a suitable foaming apparatus, which injects air into the diluted solution to obtain the desired dilution, and does so at sufficient velocity and volume so that the result is a foam having good consistency. This foam may then be sent along a suitable conduit into the sewer itself, and conducted along it for a certain distance. The hose may be gradually withdrawn from the sewer and through a manhole as the foam is injected, so that the foam initially is conducted a considerable distance from the manhole and the distance shortens as the hose outlet is drawn back to the manhole. The foamed material will then act without any special precautions being taken; it will cling to the roots, penetrate the tissues, and act to kill the roots.

As noted before, the composition of the adjutant itself has a long storage life, and when mixed with the Vapam solution, gives a long storage life for that material too.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. An adjuvant composition for addition to a water solution of sodium methyl dithiocarbamate for rendering the whole foamable when diluted with water and air under agitation and for aiding the diluted and foamed material to rid sewers of roots consisting essentially, by weight, of approximately:

15% isopropanol
12.4% water
20.2% sodium dihexyl sulfosuccinate
13.3% seven- to ten-mole ethylene oxide adduct of octyl or nonyl phenol
11.7% sodium 2-ethyl hexyl sulfate
9.2% triethanol amine sulfonate
7.5% tetrasodium N-(-1,2 dicarboxy ethyl-)-N-octadecyl sulfosuccinamate
4.7% coconut oil superamide
4.6% lower alkyl amine sulfonate
1.4% tetrasodium ethylene diamine acetic acid.

2. The adjuvant of claim 1 wherein said seven- to ten-mole ethylene oxide adduct is nine-mole ethylene oxide adduct of nonyl phenol.

3. A concentrated long-term storable formulation for dilution with water and foaming with air, for controlling root growth in sewers, comprising, by weight, approximately the following:

A. 74.15 parts of a solution made up essentially of about
37% alkali metal alkyl dithiocarbamate
63% water, and
B. 22.31 parts of a solution made up essentially of about
15% isopropanol
12.4% water
20.2% sodium dihexyl sulfosuccinate
13.3% seven- to ten-mole ethylene oxide adduct of octyl or nonyl phenol
11.7% sodium 2-ethyl hexyl sulfate
9.2% triethanol amine sulfonate
7.5% tetrasodium N-(-1,2 dicarboxy ethyl-)-N octadecyl sulfosuccinamate
4.7% coconut oil superamide
4.6% dimethyl or isopropyl amine sulfonate
1.4% tetrasodium ethylene diamine acetic acid, the formulation having a pH between 9 and 10.

4. The formation of claim 3 wherein the dithiocarbamate is sodium methyl dithiocarbamate.

5. The formulation of claim 3 wherein the ethylene oxide adduct is nine-mole ethylene oxide adduct of nonyl phenol.

6. The formulation of claim 3 also having 3.54 parts of a dry material made up essentially of about
50% dichlobenil
50% wettable clay,
as a suspension therein.

7. A sewer cleaning composition comprising a foam containing air, one hundred parts by weight of the formulation of claim 6 and two thousand parts by weight of water.

8. A sewer cleaning composition comprising a foam containing air, one hundred parts by weight of the formulation of claim 3 and two thousand parts by weight of water.

9. A concentrated, long-term storable formulation for dilution with water and foaming with air, for controlling root growth in sewers, comprising, by weight, approximately the following:

A. 74.15 parts of a solution made up essentially of
37% sodium methyldithiocarbamate
63% water
B. 22.31 parts of a solution made up essentially of
15% isopropanol
12.4% water
20.2% sodium dihexyl sulfosuccinate
13.3% nine mole ethylene oxide adduct of nonyl phenol
11.7% sodium 2-ethyl hexyl sulfate
9.2% triethanol amine sulfonate
7.5% tetrasodium N-(-1,2 dicarboxy ethyl-)-N octadecyl sulfosuccinamate
4.7% coconut oil superamide
4.6% dimethyl or isopropyl amine sulfonate
1.4% tetrasodium ethylene diamine acetic acid, and
C. 3.54 parts of a dry material made up essentially of
50% dichlobenil
50% wettable clay, the formulation having a pH of about 9.5.

10. A sewer-cleaning composition comprising an airfoam containing one hundred parts by weight of the concentrated formulation of claim 9 and two thousand parts by weight of water.

11. A method of killing roots in sewers, comprising making a foam containing two thousand parts by weight of water, sufficient air to provide the foam, and one hundred parts by weight of a concentrated formulation comprising, by weight, approximately the following:

A. 74.15 parts of a solution made up essentially of
37% sodium methyldithiocarbamate
63% water,
B. 22.31 parts of a solution made up essentially of
15% isopropanol
12.4% water
20.2% sodium dihexyl sulfosuccinate
13.3% nine mole ethylene oxide adduct of nonyl phenol
11.7% sodium 2-ethyl hexyl sulfate
9.2% triethanol amine sulfonate
7.5% tetrasodium N-(-1,2 dicarboxy ethyl-)-N octadecyl sulfosuccinamate
4.7% coconut oil superamide
4.6% isopropyl or dimethyl amine sulfonate
1.4% tetrasodium ethylene diamine acetic acid, and
C. 3.54 parts of a dry material made up essentially of
50% dichlobenil
50% wettable clay, and distributing the foam along the sewer in quantity sufficient to cover the roots in the sewer.

* * * * *